US005265950A

United States Patent [19]

Atkinson

[11] Patent Number: 5,265,950

[45] Date of Patent: Nov. 30, 1993

[54] LOCKING APPARATUS FOR GUN CABINETS

[75] Inventor: Bruce M. Atkinson, Nipigon, Canada

[73] Assignee: Hardworks, Inc., Nipigon, Canada

[21] Appl. No.: 818,313

[22] Filed: Jan. 8, 1992

[51] Int. Cl.[5] ..... A47F 7/00; E05B 65/00

[52] U.S. Cl. ..... 312/216; 312/221; 211/64

[58] Field of Search ..... 312/216, 219, 220, 221; 211/4, 64

[56] References Cited

U.S. PATENT DOCUMENTS

| | | | |
|---|---|---|---|
| 1,378,285 | 5/1921 | Schwartz | 312/221 |
| 1,951,255 | 3/1934 | Parker . | |
| 2,070,904 | 2/1937 | Jennings . | |
| 2,593,402 | 4/1952 | Aitchison . | |
| 2,623,639 | 12/1952 | Levy . | |
| 2,855,108 | 10/1958 | Haapala | 211/64 |
| 2,958,422 | 11/1960 | Caloiero . | |
| 2,958,423 | 11/1960 | Caldiero et al. | 211/64 |
| 3,516,719 | 6/1970 | Weisblat | 312/216 |
| 3,776,007 | 12/1973 | Himsl | 312/219 |
| 4,113,107 | 9/1978 | Jaeger . | |
| 4,461,385 | 7/1984 | Clouser | 211/64 |
| 4,915,460 | 4/1990 | Nook et al. | 312/216 |
| 5,103,659 | 4/1992 | Benefield, Sr. | 312/216 |

*Primary Examiner*—Victor N. Sakran

*Attorney, Agent, or Firm*—Bereskin & Parr

[57] ABSTRACT

Locking apparatus for wooden cabinets for long guns such as rifles and shot guns comprises a lower stationary metal band horizontally mountable in the cabinet at about trigger height, and an upper metal band horizontally mountable in the cabinet above the lower band at about barrel height. The upper band comprises a back bar fixedly mountable to the back of the cabinet, side bars fixedly mountable to the sides of the cabinet, and a removable front locking bar which is releasably securable to the side bars. The locking bar is engaged to one of the side bars by means of a tang in one end of the locking bar which mates with an aperture in the one side bar, and is locked to the other side bar by a pin-tumber type lock in a housing coupled to the other side wall having a cam which mates with an aperture in the other end of the locking bar.

20 Claims, 3 Drawing Sheets

LOCKING APPARATUS FOR GUN CABINETS

BACKGROUND OF THE INVENTION

The present invention relates to locking apparatus for long guns such as rifles and shot guns, and to gun cabinets having locking apparatus.

Wooden gun cabinets usually have framed glass front doors for displaying the rifles and shot guns mounted therein. Typically, the glass front doors of these gun cabinets include a locking mechanism in the frame thereof, designed to prevent curious children and thieves from gaining access to the rifles stored therein. However, it is relatively easy for a thief to circumvent these locking mechanisms by breaking the glass.

Attempts have been made in the past to foil such unauthorized access to gun cabinets by providing a locking mechanism which comprises a cable or chain adapted to be threaded through the trigger guards of the guns mounted in the cabinet, but this sort of locking mechanism tends to be time consuming to operate and unsightly.

There is accordingly a need for a more secure locking apparatus for wooden gun cabinets having glass front doors, which protects curious children, and makes it more difficult for "snatch and grab" thieves to steal expensive guns therefrom.

SUMMARY OF THE INVENTION

The present invention is directed to a locking apparatus for use in a cabinet for long guns, having a pair of opposed side walls, a back wall, a top and a bottom, and to a gun cabinet utilizing such locking apparatus. The subject locking apparatus comprises a lower stationary bar mountable horizontally across the front of the cabinet between the side walls thereof, a removable upper locking bar, and upper locking bar securing means for removably securing the upper locking bar horizontally across the front of the cabinet. The lower stationary bar is mounted at a pre-selected distance from the back wall sufficient to enable a rifle to be placed between the bar and at the back of the cabinet. The removable upper locking bar is mounted by the upper locking bar securing means at a pre-selected second distance from the back of the cabinet. The locking bar securing means comprises engaging means mounted to the inside of one of the side walls for removably engaging one end of the locking bar, and locking means mounted to the inside of the other side wall for releasably locking the other end of the locking bar to the other of the side walls.

In a preferred embodiment, the locking apparatus of the subject invention comprises a lower stationary rectangular metal band mounted to the inside of the cabinet in a fixed fashion in a horizontal plane, an upper rectangular metal band mountable to the inside of the cabinet above the lower stationary band in a horizontal plane, comprising a back bar and side bars fixably mounted to the back wall and side walls of the cabinet in a horizontal fashion, a removable front locking bar dimensioned to extend between the side bar, and securing means for removably securing the front locking bar to the side bar.

Preferably, the back and side sections of the lower stationary band and the back bar and the back sections of the side bars of the upper band are embedded in the inside surface of the cabinet, and covered with wood. The securing means preferably comprises engaging means for engaging one end of the removable locking bar to one side bar of the upper band and locking means for releasably locking the other end of the removable locking bar to the other side bar of the upper band. The engaging means preferably comprises an aperture in the one side bar section and a tang extending from the one end of the locking bar dimensioned to fit through the aperture. The locking means preferably comprising a housing extending from the other side bar into the interior of the cabinet for receiving a key-operated locking mechanism having an extendible cam, and an aperture in the other end of the locking bar dimensioned to mate with the cam.

DESCRIPTION OF THE PREFERRED EMBODIMENT

Figure 1:
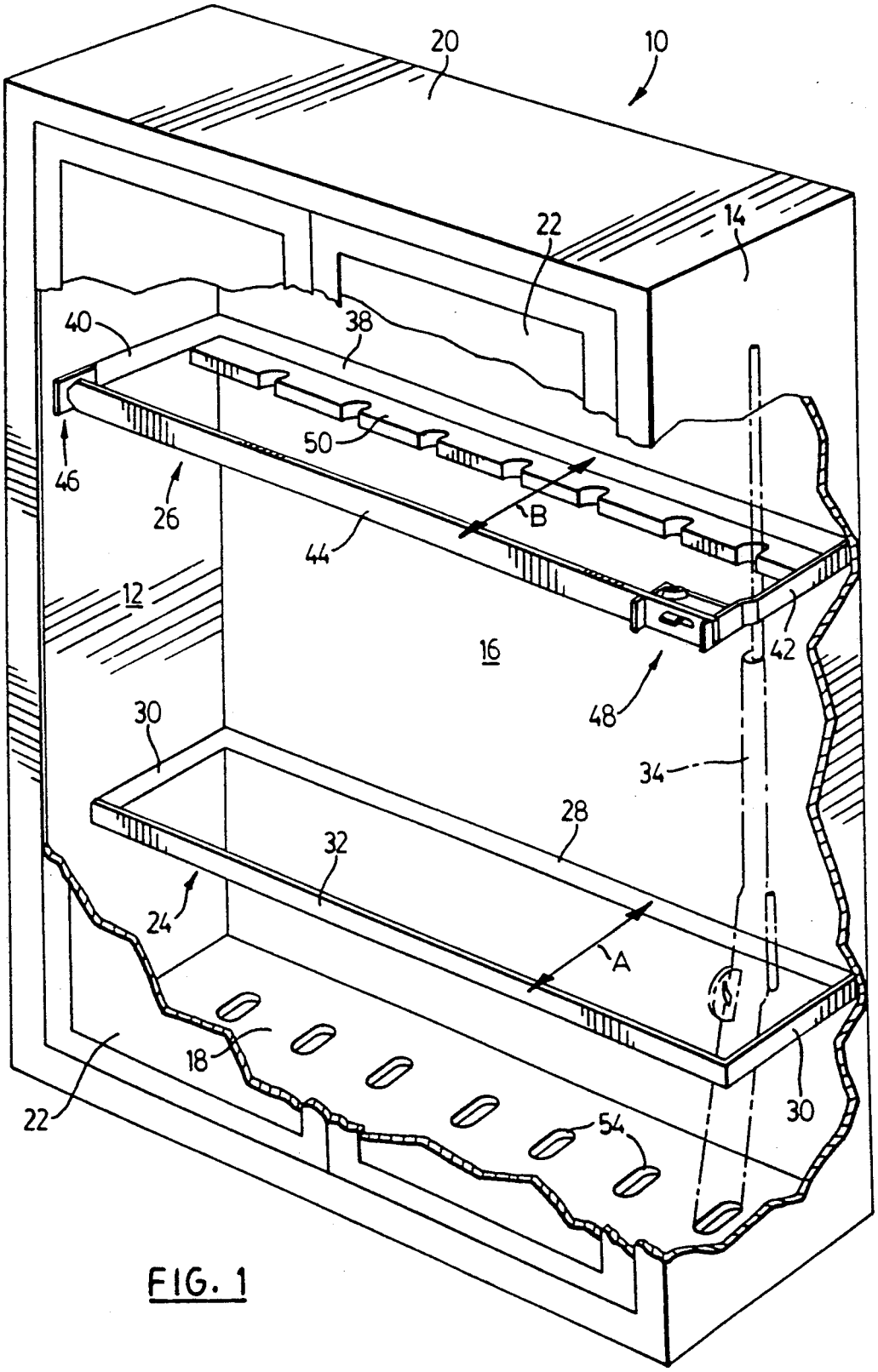
FIG. 1 is a partially cut away perspective view of a gun cabinet having the subject locking apparatus installed therein.

Referring now to FIG. 1, the subject locking mechanism for gun cabinet 10 having opposed side walls 12, 14, back wall 16, bottom 18, top 20 and glass front doors 22, comprises lower stationary band showing generally as 24 and upper band shown generally as 26.

Stationary band 24 is a rectangular closed loop of rigid flat strip material, preferably 1¼ inch steel, having a horizontal longitudinal axis and a vertical transverse axis when mounted in cabinet 10. Stationary band 24 comprises a back bar section 28 and side bar sections 30 embedded within the inside surface of the cabinet and covered with wood, and stationary front bar section 32 cladded with wood. Stationary band 24 is mounted in a horizontal plane at approximately trigger-height (about 12 inches) from the bottom 18 of cabinet 10. The depth A of lower band 24 must be sufficient to enable rifles 34 to be placed between band 24 and the back wall 16 of cabinet 10, and is preferably in the range of about 7178 to 8 inches.

Upper band 26 comprises a back bar 38 embedded within the surface of cabinet back wall 16, side bars 40, 42 rigidly coupled to back bar 38 and partially embedded in side walls 12, 14 of cabinet 10, and a removable front locking bar 44 cladded with wood. Upper band 26 is preferably made from the same material as lower band 24. Locking bar 44 of upper band 26 is secured to side bar 40 by engaging means shown generally as 46 and locked to side bar 42 by locking means shown generally as 48. Upper band 26 is mounted horizontally in cabinet 10, above stationary band 24 at approximately barrel height of rifles 34, preferably about 32 inches above the bottom 18 of cabinet 10. The depth B of upper band 26 is preferably about 6½ inches.

Cabinet 10 also preferably comprises barrel rest 50 having a plurality of contoured apertures for receiving the barrels of guns 34, preferably mounted in a horizontal plane just below back bar 38 of upper band 26, and a plurality of stock pits 54 in bottom 18 shaped for receiving the stocks of guns 34.

Figure 2:
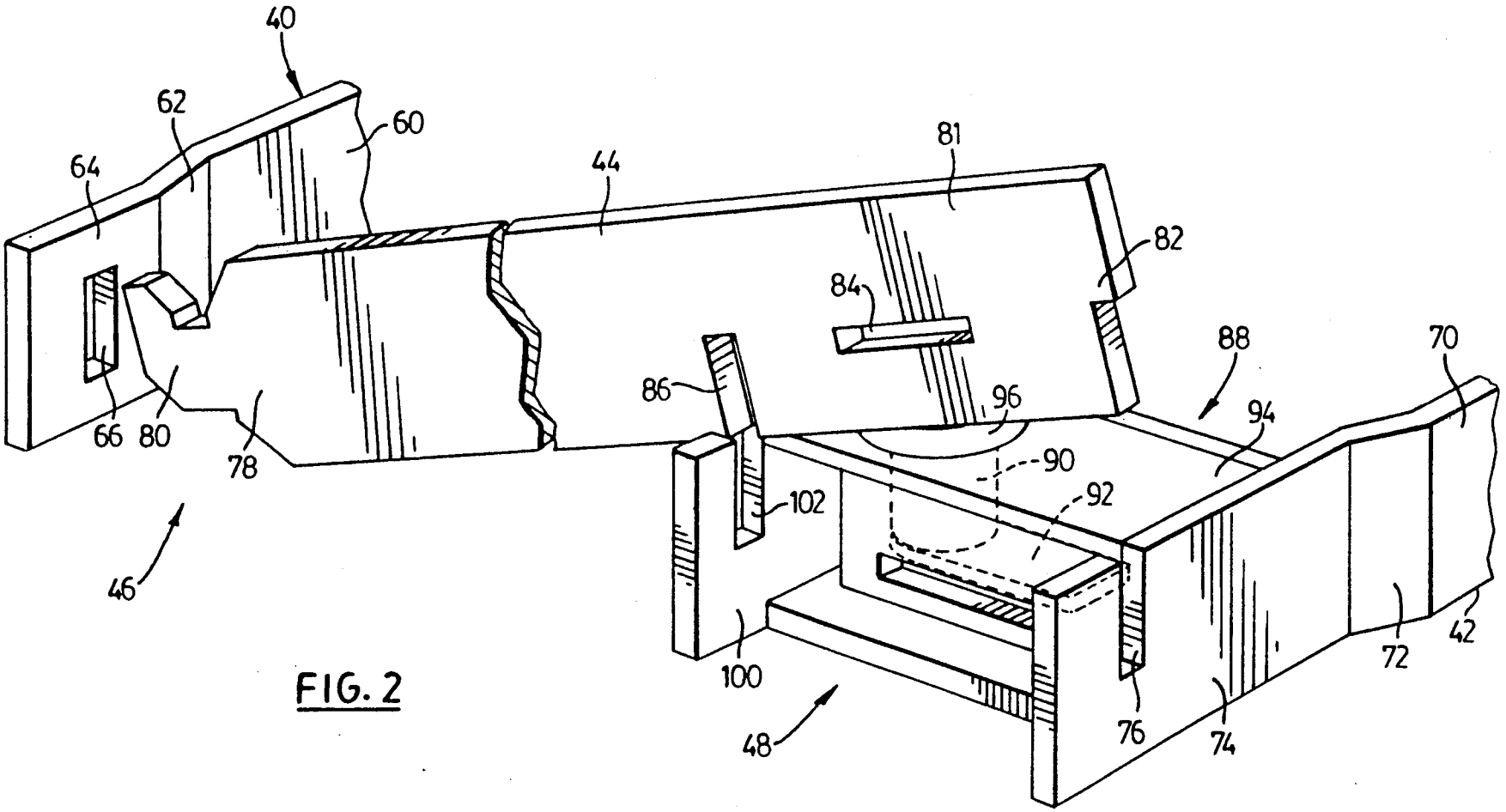
FIG. 2 is a perspective view of a portion of the upper band of the subject locking apparatus, showing the locking bar about to be engaged.

Referring now to FIG. 2, left side bar 40 of upper band 26 comprises straight rear section 60 embedded within side wall 12 of cabinet 10, angled mid-section 62 extending out of wall 12, and straight front section 64 parallel to straight section 60 and displaced about ½ inch from side wall 12. The forward portion of straight section 64 has a vertical aperture 66 therein. Right side bar 42 comprises straight rear section 70 embedded within the surface of side wall 14 covered with wood, angled midsection 72 extending out of the surface of side wall 14, and straight front section 74 parallel to straight back section 70 and displaced from the inside surface of side wall 14 by about ½ inch. Side bar front section 74 has a vertical slot 76 extending downwardly from the top thereof.

Removable locking bar 44 has a first end 78 having extending therefrom an upwardly extending tang or hook 80 dimensioned to fit through rectangular vertical aperture 66 in side bar 40, and a second end 81 having a notched leading edge 82, horizontally extending rectangular aperture 84 and a vertical slot 86 extending upwardly from the bottom surface thereof.

Extending inwardly from front section 74 of side bar 42 is lock housing 88 for housing a pin-tumbler type locking mechanism 90 having cam 92. Lock housing 88 comprises top 94 having a double-D aperture for receiving the key-hole portion 96 of lock 90, bottom 98, and side portion 100 having a downwardly extending vertical slot 102 in a forward portion thereof dimensioned to mate with slot 86 in removable locking bar 44. Similarly, notched leading edge 82 of removable locking bar 44 is dimensioned to mate with slot 76 in front section 74 of side bar 42.

Figure 3:
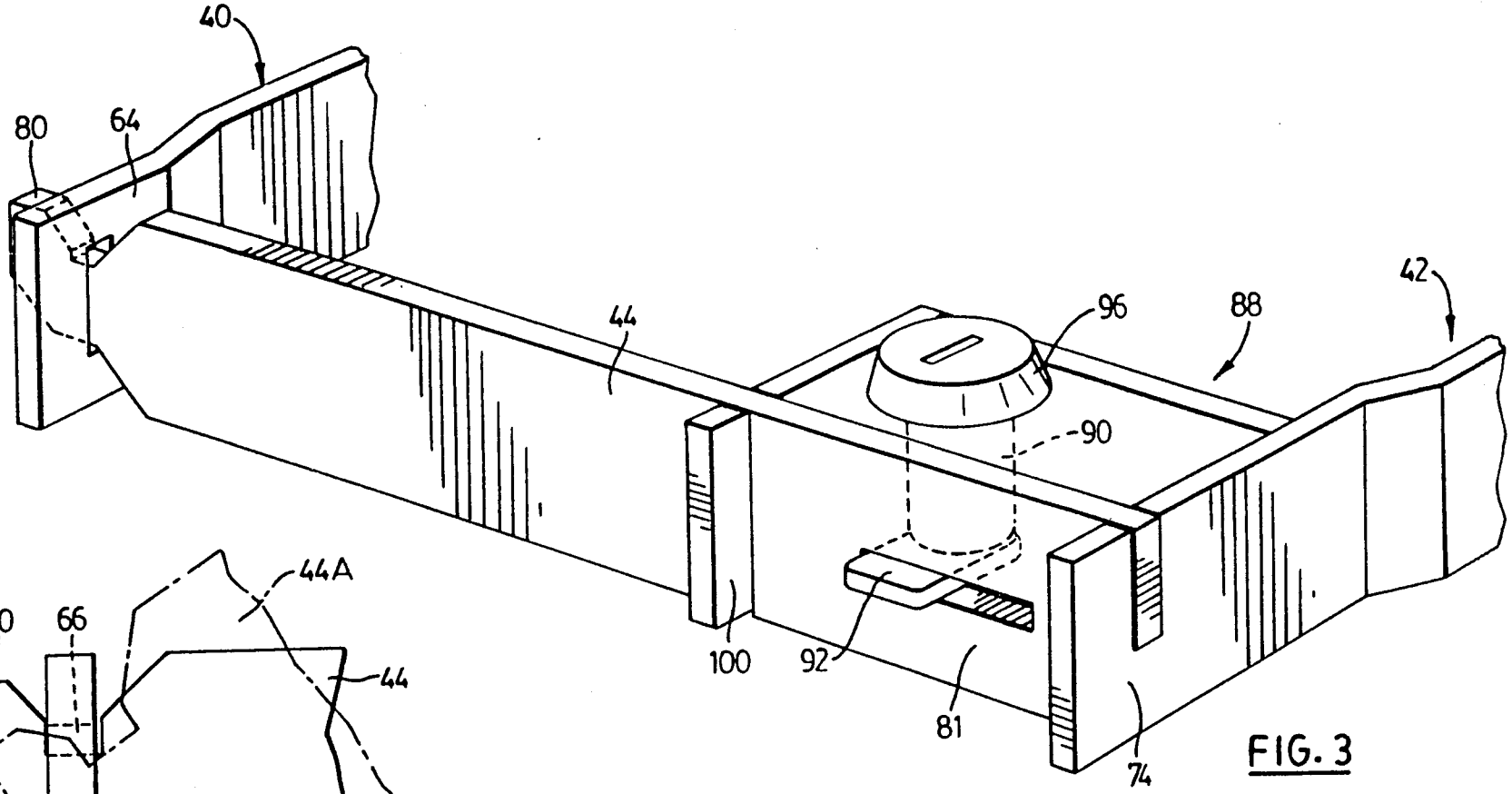
FIG. 3 is a perspective view of the same portion of the upper band, showing the locking bar engaged, and the locking mechanism locked.

Referring now to FIG. 3, locking bar 44 is shown in its locked position, with tang 80 shown engaged in aperture 66 of front portion 64 of side bar 40, and second end 81 of locking bar 44 shown engaged with front portion 74 of side bar 42, side wall 100 of lock housing 88, and cam 92 of lock mechanism 90.

Figure 4:
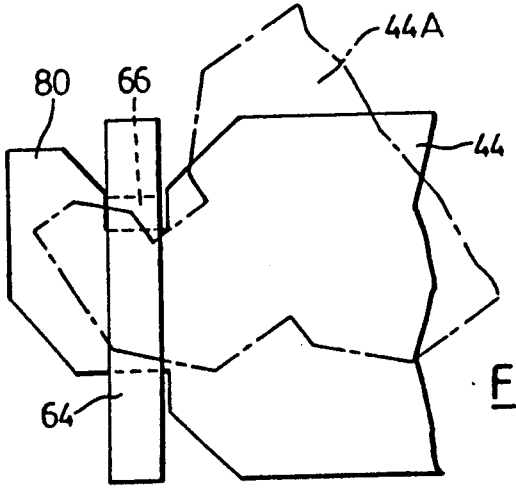
FIG. 4 is a front elevational view of one end of the locking bar being engaged with the side bar portion of the upper band.

In operation, removable locking bar 44 is removed, and guns 34 are placed stock first through lower stationary band 24. Locking bar 44 of upper band 24 is then placed at about a 45° angle shown by the ghost lines 44A in FIG. 4, and tang 80 is placed through aperture 66 in front section 64 of side bar 40. End 81 of locking bar 44 is then rotated downwardly, such that notched portion 82 mates with slot 76, and slotted portion 86 mates with slot 102. When pin-tumbler locking mechanism 90 is activated by turning an appropriate key placed therein, cam 92 rotates by 90° and engages with horizontal slot 84, as shown in FIG. 3.

The metal locking bands 24, 26 of the preferred embodiment of the invention prevent a thief from disengaging the locking mechanism merely by spreading the sides of the cabinet by means of a suitable jack or pry bar. Also, having two points of contact between removable locking bar 44 and side bar 42/lock housing 88, namely at slotted portion 86 and notched portion 82, makes it more difficult for a thief to disengage the lock mechanism by pulling forwardly on and bowing locking bar 44.

It should be understand that while the preferred embodiment of the subject invention is illustrated and described therein, various changes can be made to this preferred embodiment, without departing from the subject invention, the scope of which is defined in the appended claims.

I claim:

1. Locking apparatus for use in a wooden cabinet for long guns, such as rifles and shot guns, having a pair of opposed side walls, a back wall, a top and a bottom, comprising:

(a) a lower stationary metal bar mountable horizontally across the front of the cabinet between the side walls thereof above the bottom and at a distance from the back wall sufficient to enable a long gun to be placed between the bar and the back wall of the cabinet;

(b) a removable upper metal locking bar having a length less than the width of the cabinet and a first end and a second end wherein the first end of the locking bar comprises a tang extending upwardly therefrom, and wherein the leading edge of the second end of the locking bar has a portion having a vertical notch therein; and (c) securing means for removably securing the upper locking bar horizontally across the front of the cabinet above the lower stationary bar at a pre-selected distance from the back of the cabinet, comprising engaging means mounted to the inside of one of the side walls for removably engaging the first end of the locking bar, wherein the engaging means comprises a bar mounted to the one side wall having a forward portion spaced from the one side wall having an aperture therein dimensioned for receiving the tang, and locking means mounted to the inside of the other of the side walls for releasably locking the second end of the locking bar to the other of the side walls, wherein the locking means comprises a vertical slot for mating with the notch in the locking bar, a lock housing extending from the other side wall towards the interior of the cabinet, and a locking mechanism housed in the lock housing having a rotatable cam, and wherein the second end of the locking bar comprises an aperture therein dimensioned for mating with the cam.

2. Locking apparatus for use in a cabinet for long guns such as rifles and shot guns, having a pair of opposed side walls, a back wall, a top and a bottom, comprising:

(a) a lower stationary rectangular rigid band horizontally mountable to the inside of the back wall and side walls of the cabinet at a pre-selected height above the bottom, having a pre-selected depth, comprising a back wall section mountable horizontally across the back wall of the cabinet, side wall sections mountable horizontally across a portion of the side walls, and a fixed front section extending between the side wall sections mountable horizontally across the front of the cabinet; and (b) an upper rectangular rigid band horizontally mountable to the inside of the cabinet above the lower band, comprising a back bar fixedly mountable to the back wall, side bars rigidly coupled to the back bar and fixedly mountable to the side walls of the cabinet, a removable front locking bar dimensioned to extend between the side bars and securing means for removably securing the front locking bar to the side bars, (c) wherein the securing means comprises engaging means for engaging one end of the removably locking bar to one of the side bars and locking means for releasably locking the other end of the removable locking bar to the other side bar.

3. The locking apparatus as defined in claim 2, wherein the engaging means comprises an aperture in a forward portion of one of the side bars and a tang extending from one end of the locking bar dimensioned to fit through the aperture.

4. The locking apparatus as defined in claim 2, wherein the locking means comprises housing means extending from the other of the side bars into the interior of the cabinet in the plane of the upper band for housing a key-operated locking mechanism having an extendable cam, and an aperture in the other end of the locking bar dimensioned to mate with the cam.

5. The locking apparatus as defined in claim 2, wherein the locking means also comprises a slot in the other side bar portion and a notch in the leading edge of the locking bar dimensioned to fit into the slot.

6. The locking apparatus as defined in claim 2, wherein the lower band comprises a rectangular closed loop of flat strip metal having a horizontally extending longitudinal axis and a vertically extending transverse axis.

7. The locking apparatus as defined in claim 6, wherein the locking means also comprises a side portion of the housing means parallel to and spaced from the other side bar, having a slotted front portion dimensioned to mate with a second slot in the locking bar spaced inwardly from the leading edge thereof.

8. The locking apparatus as defined in claim 2, wherein the back wall section and side wall sections of the lower stationary band are embedded in the inside surface of the cabinet.

9. The locking apparatus as defined in claim 2, wherein the back bar of the upper band is embedded in the inside surface of the cabinet.

10. The locking apparatus as defined in claim 9, wherein the side bars of the upper band have rear straight sections embedded in the surface of the back walls of the cabinet, angled mid-sections extending out of the surface of the side walls of the cabinet, and straight front sections parallel to the back sections but displaced from the inside surface of the side walls of the cabinet.

11. The locking apparatus as defined in claim 10, wherein the front section of the side bar mountable to the one side wall has an aperture dimensioned to mate with a tang extending upwardly from the one end of the locking bar.

12. The locking apparatus as defined in claim 10, wherein the front section of the side bar mountable to in the other side wall has mounted thereto a housing extending in the plane of the upper band for housing a locking mechanism.

13. The locking mechanism as defined in claim 12, wherein the housing comprises a top having an aperture therein for receiving a key hole portion of the locking mechanism.

14. The locking apparatus as defined in claim 13, wherein the housing comprises a side wall portion parallel to the front section of the other side bar, having a slot therein for receiving a slotted portion of the locking bar.

15. The locking apparatus as defined in claim 2, wherein the front section of the lower band and the locking bar of the upper band are cladded with wood.

16. The locking apparatus as defined in claim 2, wherein the upper band comprises a rectangular loop of flat strip metal having a horizontally extending longitudinal axis and a vertically extending transverse axis, when the band is mounted in the cabinet and the locking bar is in place.

17. A wooden cabinet for long guns such as rifles and shot guns, comprising:

(a) a pair of opposed side walls, a back wall, a top, a bottom, and framed glass front doors;

(b) a lower stationary rectangular metal band mounted in the inside of the cabinet at a pre-selected height above at the bottom thereof in a horizontal plane, and having a pre-selected depth, comprising a back wall section extending horizontally across at the back wall of the cabinet, side wall sections extending horizontally across a portion of the side walls of the cabinet, and a fixed front section extending horizontally across the front of the cabinet; and (c) an upper rectangular metal band mounted to the inside of the cabinet in a horizontal plane at a pre-selected height above the lower band, and having a pre-selected depth, comprising a back bar extending horizontally across the back wall of the cabinet, side bars rigidly connected to the back bar and mounted to the side walls of the cabinet in a fixed fashion, a removable front locking bar dimensioned to extend between the side bars, and securing means associated with the side bars and locking bar for removably securing the locking bar to the side bars.

18. The cabinet as defined in claim 17, further comprising spacing means for spacing the long guns in a vertical position apart from one another.

19. The cabinet as defined in claim 18, wherein the spacing means comprises a plurality of spaced indentions in the bottom of the cabinet contoured to fit the end portions of gun stocks, and a rack mounted to the back wall of the cabinet in a horizontal plane at barrel height, having a plurality of spaced notches countoured to fit gun barrels.

20. The cabinet as defined in claim 17, wherein the securing means comprises engaging means for engaging one end of the removable locking bar to one of the side bars and locking means for releasably locking the other end of the removable locking bar to the other of the side bars.

* * * * *